US005239589A

United States Patent [19]

Yang et al.

[11] Patent Number: 5,239,589

[45] Date of Patent: Aug. 24, 1993

[54] LOW PROFILE-PIN MOUNT-PRINTED CIRCUIT BOARD SPEAKER

[75] Inventors: Su-Pei Yang; Alex C. C. Tai, both of Taipei, Taiwan

[73] Assignee: Regal Technology Co. Ltd., Taipei, Taiwan

[21] Appl. No.: 855,796

[22] Filed: Mar. 23, 1992

[51] Int. Cl.[5] ..... H04R 25/00

[52] U.S. Cl. ..... 381/188; 381/205

[58] Field of Search ..... 381/188, 205, 87, 88, 381/90; 361/400, 405

[56] References Cited

U.S. PATENT DOCUMENTS 5,168,527 12/1992 Loya ..... 381/188

*Primary Examiner*—Jin F. Ng
*Assistant Examiner*—Sinh Tran
*Attorney, Agent, or Firm*—Wenderoth, Lind & Ponack

[57] ABSTRACT

A low profile-pin mount-printed circuit board speaker having a locating plate attached to the stepped peripheral edge of a speaker through a dowel joint, two contact pins secured to the locating plate through a plug-in joint and electrically connected to the speaker, wherein said contact pins have hooked portions respectively retained in grooves on the locating plate for positioning, when the contact pins inserted into through holes of the locating plate.

1 Claim, 2 Drawing Sheets

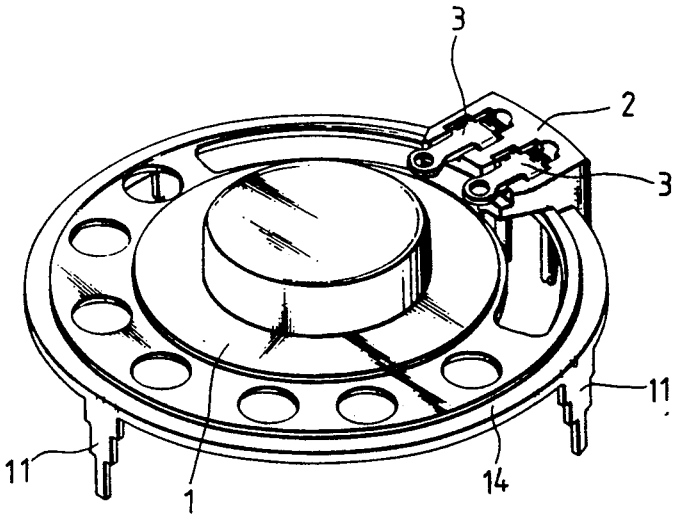
FIG,1
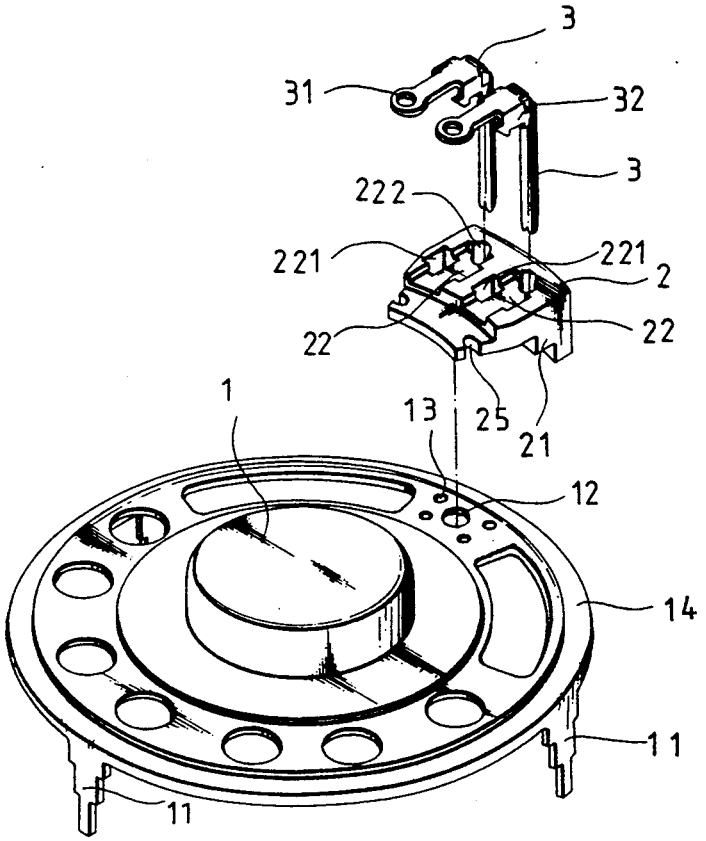
FIG,2

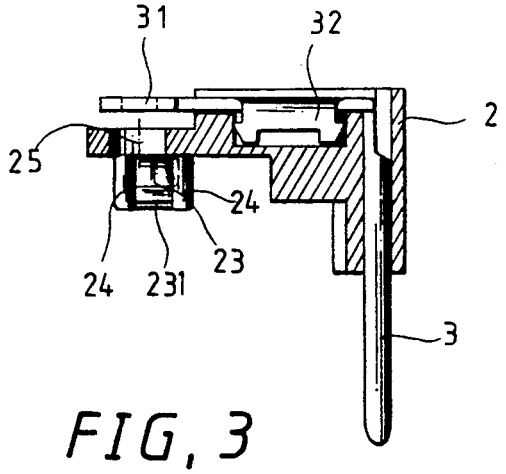
FIG, 3
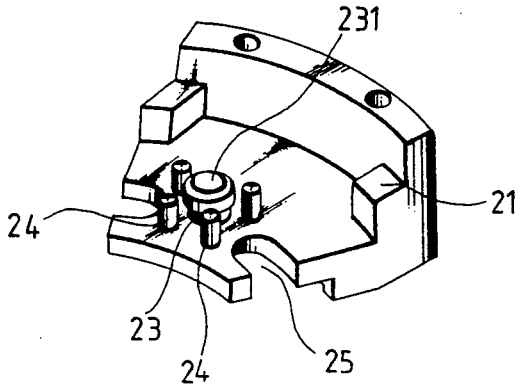
FIG, 4
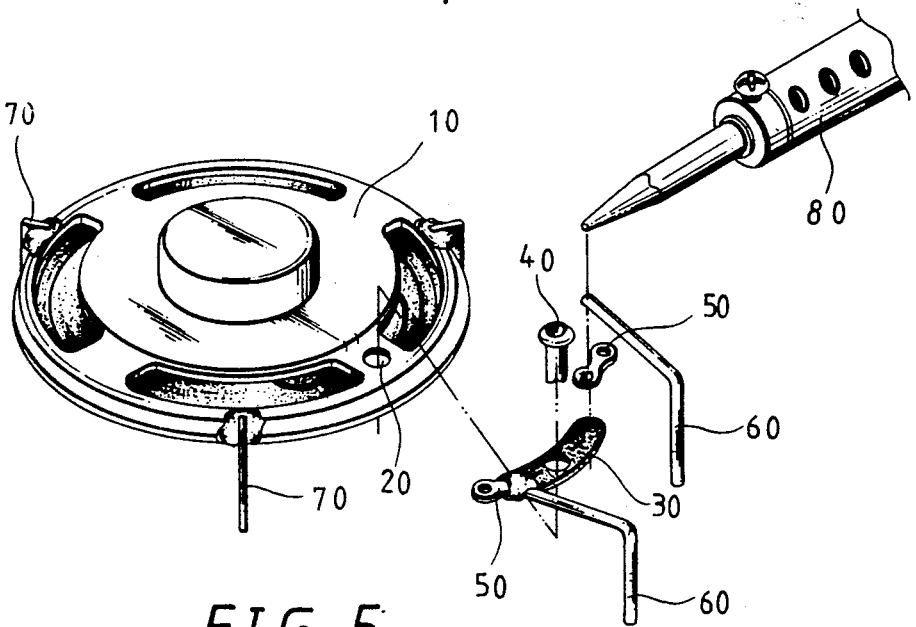
FIG, 5

LOW PROFILE-PIN MOUNT-PRINTED CIRCUIT BOARD SPEAKER

BACKGROUND OF THE INVENTION (a) Field of the Invention

The present invention relates to loudspeakers, and more particularly, the present invention relates to a low profile-pin mount-printed circuit board speaker.

(b) Description of the Prior Art

FIG. 5 illustrates a low profile-pin mount-printed circuit board speaker according to the prior art. As illustrated, the speaker 10 has a hole 20 adjacent to the peripheral edge thereof to hold an insulative locating plate 30 by a rivet 40. Two contact pins 60 are respectively secured to the insulative locating plate 30 by two conductive plates 50 through the process of soldering. The speaker 10 further comprises location pins 70 around the peripheral edge thereof for positioning on a circuit board. However, this structure of low profile-pin mount-printed circuit board speaker is difficult to assemble because much parts are used. Because the contact pins 60 are manually soldered to the conductive plates 50, it is very difficult to connect them to the conductive plates 50 at accurate angles according to the locations of the contact holes on a circuit board to be fastened. Furthermore, the speaker 10 may be damaged easily during its installation because the insulative locating plate 30 and the conductive plates 50 are to be respectively secured to the speaker 10 through a rivet joint.

SUMMARY OF THE INVENTION

One object of the present invention is to provide a low profile-pin mount-printed circuit board speaker which is consisted of less parts and inexpensive to manufacture. Another object of the present invention is to provide a low profile-pin mount-printed circuit board speaker which is easy to install without through any rivet joint.

According to the present invention, a low profile-pin mount-printed circuit board speaker is generally comprised of a speaker, a locating plate, and two contact pins. The locating plate has posts on the bottom edge thereof respectively inserted into holes on the speaker for positioning. Through holes and grooves are made on the locating plate for fastening the contact pins. The contact pins has hooked portions respectively retained in the grooves for positioning when the contact pins inserted into the through holes. Once the locating plate attached to the speaker, the contact pins are precisely retained at accurate positions for inserting into contact holes on the circuit board onto which the speaker is mounted.

BRIEF DESCRIPTION OF THE DRAWINGS

FIG. 1 is an elevational view of the preferred embodiment of the low profile-pin mount-printed circuit board speaker of the present invention;

FIG. 2 is an exploded view of the low profile-pin mount-printed circuit board speaker of FIG. 1;

FIG. 3 is a sectional assembly view the low profile-pin mount-printed circuit board speaker of FIG. 1;

FIG. 4 is an elevational view showing the back side of the locating plate used in the low profile-pin mount-printed circuit board speaker of FIG. 1; and FIG. 5 is an exploded view of a prior art low profile-pin mount-printed circuit board speaker.

DETAILED DESCRIPTION OF THE PREFERRED EMBODIMENT

Referring to FIGS. 1 and 2, the present invention is generally comprised of a speaker 1, a locating plate 2, and two contact pins 3. The internal structure of the speaker 1 is of the known art and not within the scope of the present invention. The speaker 1 has legs 11 around the stepped peripheral edge 14 thereof for positioning on a circuit board, a fastening hole 12 adjacent to the stepped peripheral edge 14 at a suitable location, and at least one locating hole 13 around the fastening hole 12. The locating plate 2 is made from a resilient plastic material comprising a stepped bottom edge 21 fitting the stepped peripheral edge 14 of the speaker 1, two recessed holes 22 on the top edge thereof, two through holes 222 on the recessed holes 22 for inserting the contact pins 3 (see FIGS. 3 and 4), two grooves 221 adjacent to the recessed holes 22, a retaining post 23 on the stepped bottom edge 21, at least one locating post 24 on the stepped bottom edge 21 around the retaining post 23, and two curved side notches 25 adjacent to the front end thereof at two opposite sides, wherein the retaining post 23 has a raised portion 231 on the top edge thereof. The contact pins 3 are respectively made from a L-shaped conductive plate having two hooked portions 32 bilaterally formed on a horizontal connecting end 31 thereof at the back. By inserting the hooked portions 32 in either groove 221, the contact pins 3 are respectively firmly retained in the recessed holes 22.

The aforesaid parts can be conveniently assembled. The assembly process is outlined hereinafter. The contact pins 3 are respectively secured to the locating plate 2 by inserting them into the through holes 222 on the recessed holes 22, permitting the hooked portions 32 to be respectively retained in the grooves 221. Then, insert the retaining post 23 and the at least one locating post 24 into the fastening hole 12 and the at least one locating hole 13 on the speaker 1, permitting the locating plate 2 to be firmly secured to the speaker 1. Once the raised portion 231 has been inserted into the fastening hole 12, the retaining post 23 becomes firmly secured to the fastening hole 12, and therefore, the locating plate 2 becomes firmly secured to the speaker 1. Because the contact pins 3 are fastened in the through holes 222 on the locating plate 2, and the locating plate 2 is secured to the speaker 1 at the fixed location, the contact pins 3 are secured to the speaker 1 at the predetermined angle positions, and therefore, the contact pins 3 can be accurately inserted into contact holes on the circuit board onto which the speaker 1 is mounted.

What is claimed is:

1. A low profile-pin mount-printed circuit board speaker comprised of a speaker body having legs for positioning on a circuit board, a locating plate secured to said speaker to hold two contact pins, and characterized in that:

said speaker body comprises a fastening hole adjacent to a stepped peripheral edge thereof, and at least one locating hole around said fastening hole;

said locating plate comprises a stepped bottom edge engaged with said stepped peripheral edge of said speaker, two recessed holes on a top edge thereof, two through holes respectively formed on said recessed holes for inserting said contact pins, two grooves adjacent to said recessed holes, a retaining post on said stepped bottom edge inserted into said fastening hole, at least one locating post on said stepped bottom edge around said retaining post respectively inserted into said at least one locating hole, and two curved side notches adjacent to a front end thereof at two opposite sides, said retaining post having a raised portion on a top edge thereof retained in said fastening hole;

said contact pins are respectively made from a L-shaped conductive plate having two hooked portions bilaterally formed on a horizontal connecting end thereof at the back, said hooked portions being retained in said grooves to firmly secure said contact pins in said through holes.

* * * * *